US007053323B1

(12) United States Patent
Beerling

(10) Patent No.: US 7,053,323 B1
(45) Date of Patent: May 30, 2006

(54) LIQUID METAL SWITCH EMPLOYING AN ELECTRICALLY ISOLATED CONTROL ELEMENT

(75) Inventor: Timothy Beerling, San Francisco, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 11/121,722

(22) Filed: May 4, 2005

(51) Int. Cl.
*H01H 57/00* (2006.01)

(52) U.S. Cl. ..... 200/181; 200/182

(58) Field of Classification Search ..... 200/181–194, 200/214, 229, 233
See application file for complete search history.

(56) References Cited

U.S. PATENT DOCUMENTS 5,808,593 A * 9/1998 Sheridon ..... 345/84
6,545,815 B1 * 4/2003 Kroupenkine et al. ..... 359/665
6,665,127 B1 * 12/2003 Bao et al. ..... 359/665
6,829,415 B1 * 12/2004 Kroupenkine et al. ..... 385/37
6,847,493 B1 * 1/2005 Davis et al. ..... 359/665

* cited by examiner

*Primary Examiner*—Michael Friedhofer
*Assistant Examiner*—Lisa Klaus

(57) ABSTRACT

A switch comprises a first switch element configured to actuate by electrowetting, the first switch element comprising at least two radio frequency contacts and at least two control electrodes. The switch also comprises at least two additional switch elements configured to make and break an electrical connection between the at least two control electrodes of the first switch element.

19 Claims, 7 Drawing Sheets

LIQUID METAL SWITCH EMPLOYING AN ELECTRICALLY ISOLATED CONTROL ELEMENT

BACKGROUND OF THE INVENTION

Many different technologies have been developed for fabricating switches and relays for low frequency and high frequency switching applications. Many of these technologies rely on solid, mechanical contacts that are alternatively actuated from one position to another to make and break electrical contact. Unfortunately, mechanical switches that rely on solid—solid contact are prone to wear and are subject to a condition known as "fretting." Fretting refers to erosion that occurs at the points of contact on surfaces. Fretting of the contacts is likely to occur under load and in the presence of repeated relative surface motion. Fretting typically manifests as pits or grooves on the contact surfaces and results in the formation of debris that may lead to shorting of the switch or relay.

To minimize mechanical damage imparted to switch and relay contacts, switches and relays have been fabricated using liquid metals to wet the movable mechanical structures to prevent solid to solid contact. Unfortunately, as switches and relays employing movable mechanical structures for actuation are scaled to sub-millimeter sizes, challenges in fabrication, reliability and operation begin to appear. Micromachining fabrication processes exist to build micro-scale liquid metal switches and relays that use the liquid metal to wet the movable mechanical structures, but devices that employ mechanical moving parts can be overly-complicated, thus reducing the yield of devices fabricated using these technologies. A liquid metal switch with no mechanical moving parts is disclosed in U.S. patent application Ser. No. 10/996,823, entitled "Liquid Metal Switch Employing Electrowetting For Actuation And Architectures For Implementing Same," filed on Nov. 24, 2004, assigned to the assignee of the instant application, and is incorporated herein by reference. In the above-identified application, a liquid metal switch is actuated using what is referred to as "electrowetting." To actuate a liquid metal switch using electrowetting, an electric field is generated in the vicinity of a droplet of electrically conductive liquid. The electric field causes the droplet to deform and translate across a surface. However, a radio frequency (RF) signal that is being switched by the droplet is susceptible to capacitive coupling into the circuitry that controls the electric field in the vicinity of the droplet. Therefore, it would be desirable to prevent the RF signal from capacitively coupling into the control circuitry of the liquid metal switch.

SUMMARY OF THE INVENTION

In accordance with the invention a switch is provided comprising a first switch element configured to actuate by electrowetting, the first switch element comprising at least two radio frequency contacts and at least two control electrodes. The switch also comprises at least two additional switch elements configured to make and break an electrical connection between the at least two control electrodes of the first switch element.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

The switch structure described below can be used in any application where it is desirable to provide fast, reliable switching. While described below as switching a radio frequency (RF) signal, the architecture can be used for other switching applications.

Figure 1A:
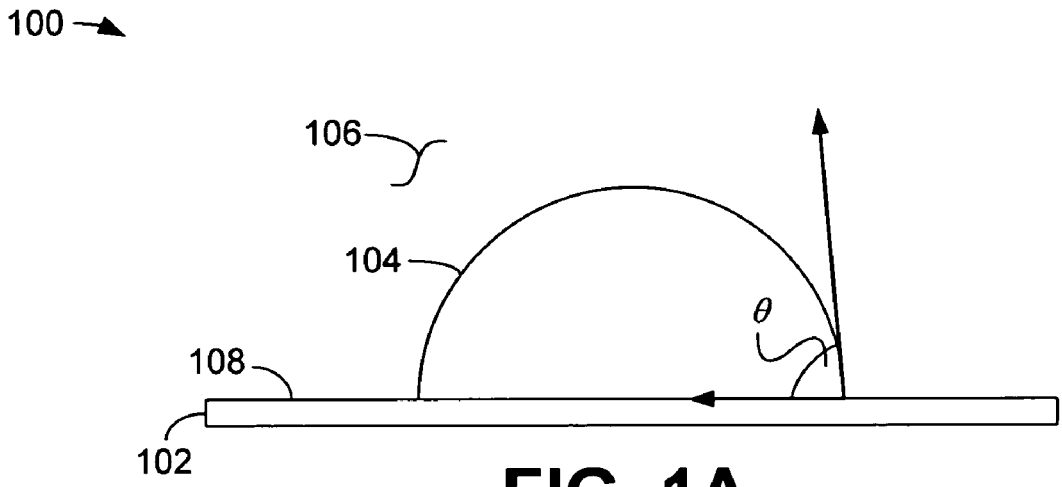
FIG. 1A is a schematic diagram illustrating a system including a droplet of conductive liquid residing on a solid surface.

Prior to describing embodiments of the invention, a brief description of the use of electrowetting to move a droplet of conductive liquid will be provided. FIG. 1A is a schematic diagram illustrating a system 100 including a droplet of conductive liquid residing on a solid surface. The droplet 104 can be, for example, mercury or a gallium alloy, and resides on a surface 108 of a solid 102. A contact angle, also referred to as a wetting angle, is formed where the droplet 104 meets the surface 108. The contact angle is indicated as θ and is measured at the point at which the surface 108, liquid 104 and gas 106 meet. The gas 106 can be, in this example, air, or another gas that forms the atmosphere surrounding the droplet 104. A high contact angle, as shown in FIG. 1A, is formed when the droplet 104 contacts a surface 108 that is referred to as relatively non-wetting, or less wettable. The wettability is generally a function of the material of the surface 108 and the material from which the droplet 104 is formed, and is specifically related to the surface tension of the liquid.

Figure 1B:
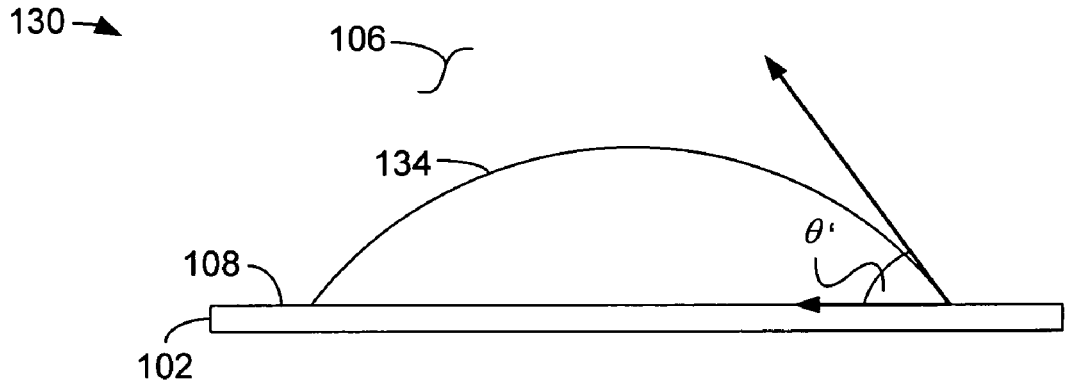
FIG. 1B is a schematic diagram illustrating the system of FIG. 1A having a different contact angle.

FIG. 1B is a schematic diagram 130 illustrating the system 100 of FIG. 1A having a different contact angle than the contact angle shown in FIG. 1A. In FIG. 1B, the droplet 134 is more wettable with respect to the surface 108 than the droplet 104 with respect to the surface 108, and therefore forms a lower contact angle, referred to as θ. As shown in FIG. 1B, the droplet 134 is flatter and has a lower profile than the droplet 104 of FIG. 1A.

The concept of electrowetting, which is defined as a change in contact angle with the application of an electrical potential, relies on the ability to electrically alter the contact angle that a conductive liquid forms with respect to a surface with which the conductive liquid is in contact. In general, the contact angle between a conductive liquid and a surface with which it is in contact ranges between 0° and 180°.

Figure 2A:
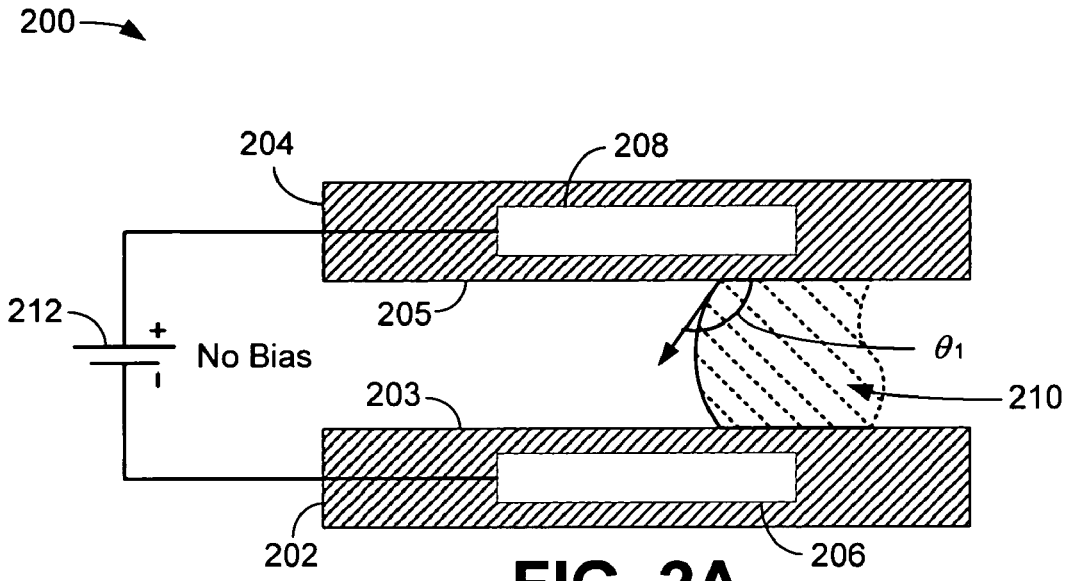
FIG. 2A is a schematic diagram illustrating one manner in which electrowetting can alter the contact angle between a droplet of conductive liquid and a surface that it contacts.

FIG. 2A is a schematic diagram 200 illustrating one manner in which electrowetting can alter the contact angle between a droplet of conductive liquid and a surface that the droplet contacts. In FIG. 2A, a droplet 210 of conductive liquid is sandwiched between dielectric 202 and dielectric 204. The dielectric can be, for example, tantalum oxide, or another dielectric material. An electrode 206 is buried, or otherwise located, within dielectric 202 and an electrode 208 is buried, or otherwise located, within dielectric 204. The electrodes 206 and 208 are coupled to a voltage source 212. In FIG. 2A, the system is electrically non-biased. Under this non-bias condition, the droplet 210 forms a contact angle, referred to as $\theta_1$, with respect to the surface 205 of the dielectric 204 that is in contact with the droplet 210. A similar contact angle exists between the droplet 210 and the surface 203 of the dielectric 202.

Figure 2B:
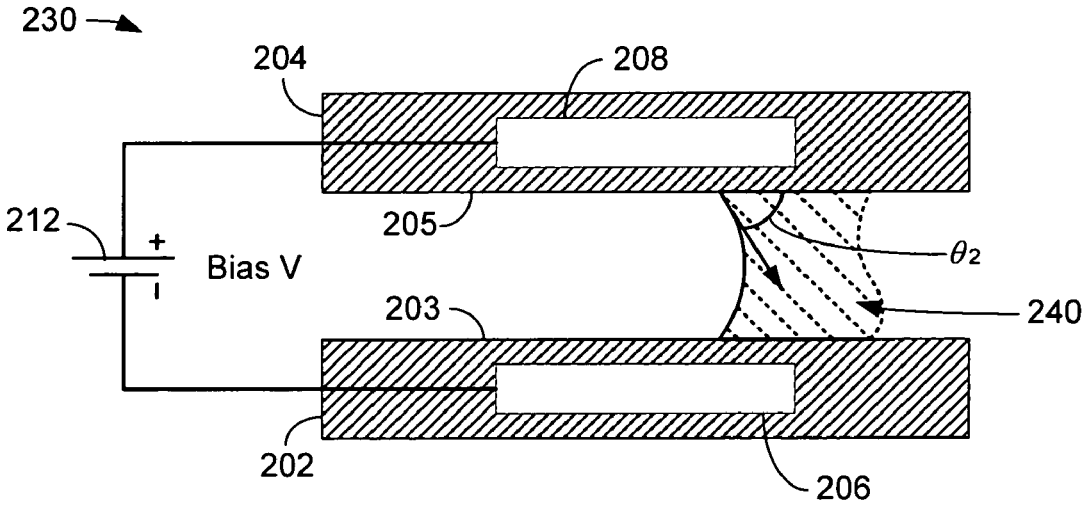
FIG. 2B is a schematic diagram illustrating the system of FIG. 2A under an electrical bias.

FIG. 2B is a schematic diagram 230 illustrating the system 200 of FIG. 2A under an electrical bias. The voltage source 212 provides a bias voltage to the electrodes 206 and 208. The voltage applied to the electrodes 206 and 208 creates an electric field through the conductive liquid droplet causing the droplet to move. The movement of the droplet 210 increases the capacitance of the system, thus increasing the stored energy of the system. In this example, the contact angle of the droplet 240 is altered with respect to the contact angle of the droplet 210. The new contact angle is referred to as $\theta_2$, and is a result of the electric field created between the electrodes 206 and 208 and the droplet 240.

It is typically desirable to isolate the droplet from the electrodes, and thus allow the droplet to become part of a capacitive circuit. The application of an electrical bias as shown in FIG. 2B, makes the surface 205 of the dielectric 204 and the surface 203 of the dielectric 202 more wettable with respect to the droplet 240 than the no-bias condition shown in FIG. 2A. Although the surface tension of the liquid that forms the droplet 240 resists the electrowetting effect, the contact angle changes as a result of the creation of the electric field between the electrodes 206 and 208. As will be described below, the change in the contact angle alters the curvature of the droplet and leads to translational movement of the droplet.

Figure 3A:
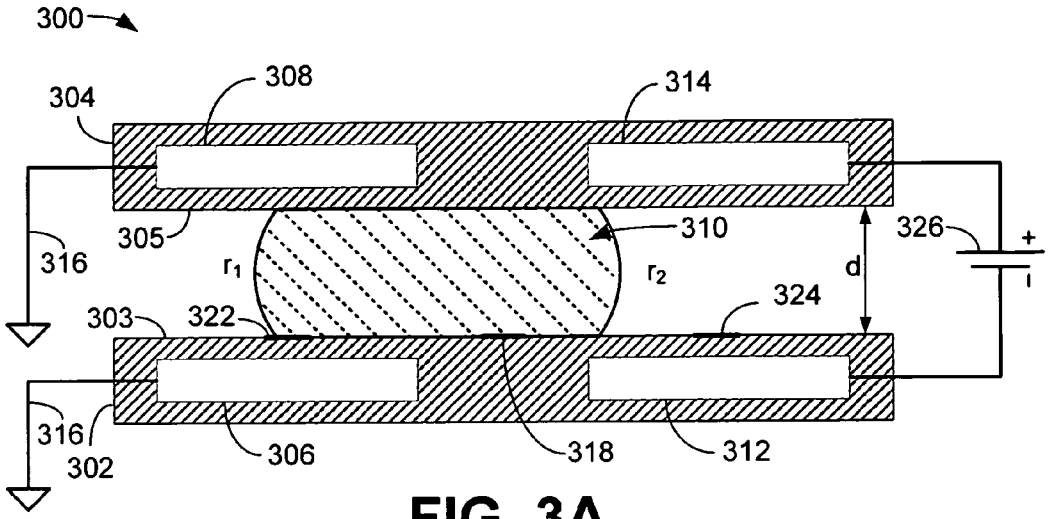
FIG. 3A is a schematic diagram illustrating an embodiment of an electrical switch employing a conductive liquid droplet.

FIG. 3A is a schematic diagram illustrating an embodiment of an electrical switch 300 employing a conductive liquid droplet. The switch 300 includes a dielectric 302 having a surface 303 forming the floor of the switch, and a dielectric 304 having a surface 305 that forms the roof of the switch. A droplet 310 of a conductive liquid is sandwiched between the dielectric 302 and the dielectric 304.

The dielectric 302 includes an electrode 306 and an electrode 312. The dielectric 304 includes an electrode 308 and an electrode 314. The electrodes 306 and 312 are buried within the dielectric 302 and the electrodes 308 and 314 are buried within the dielectric 304. In this example, and to induce the droplet 310 to move toward the electrodes 312 and 314, the electrodes 306 and 308 are coupled to an electrical return path 316 and are electrically isolated from electrodes 312 and 314, and the electrodes 312 and 314 are coupled to a voltage source 326. Alternatively, to induce the droplet 310 to move toward the electrodes 306 and 308, the electrodes 312 and 314 can be coupled to an isolated electrical return path and the electrodes 306 and 308 can be coupled to a voltage source.

In this example, the switch 300 includes electrical contacts 318, 322, and 324 positioned on the surface 303 of the dielectric 302. In this example, the contact 318 can be referred to as an input, and the contacts 322 and 324 can be referred to as outputs. As shown in FIG. 3A, the droplet 310 is in electrical contact with the input contact 318 and the output contact 322. Further, in this example, the droplet 310 will always be in contact with the input contact 318.

As shown in FIG. 3A as a cross section, the droplet 310 includes a first radius, $r_1$, and a second radius, $r_2$. When electrically unbiased, i.e., when there is zero voltage supplied by the voltage source 326, the curvature of the radius $r_1$ equals the curvature of the radius $r_2$ and the droplet is at rest. The radius of curvature, r, of the droplet is defined as $$r = \frac{d}{\cos\theta_{top} + \cos\theta_{bottom}} \quad \text{Eq. 1}$$

where d is the distance between the surface 303 of the dielectric 302 and the surface 305 of the dielectric 304, cos $\theta_{top}$ is the contact angle between the droplet 310 and the surface 305, and cos $\theta_{bottom}$ is the contact angle between the droplet 310 and the surface 303. Therefore, as shown in FIG. 3A, the droplet 310 is at rest whereby the radius $r_1$ equals the radius $r_2$, where the curvatures are in opposing directions.

Upon application of an electrical potential via the voltage source 326, a new contact angle between the droplet 310 and the surfaces 303 and 305 is defined. The following equation defines the new contact angle.

$$\cos\theta(V) = \cos\theta_o + \frac{\varepsilon}{2\gamma t}V^2 \quad \text{Eq. 2}$$

Equation 2 is referred to as Young-Lipmann's Equation, where the new contact angle, cos θ(V), is determined as a function of the applied voltage. In equation 2, ε is the dielectric constant of the dielectrics 302 and 304, γ is the surface tension of the liquid, t is the dielectric thickness, and V is the voltage applied to the electrode with respect to the conductive liquid. Therefore, to change the contact angle of the droplet 310 with respect to the surfaces 303 and 305 a voltage is applied to electrodes 314 and 312, thus altering the profile of the droplet 310 so that $r_1$ is not equal to $r_2$. If $r_1$ is not equal to $r_2$, then the pressure, P, on the droplet 310 changes according to the following equation.

$$P = \gamma\left(\frac{1}{r_1} + \frac{1}{r_2}\right) \quad \text{Eq. 3}$$

Figure 3B:
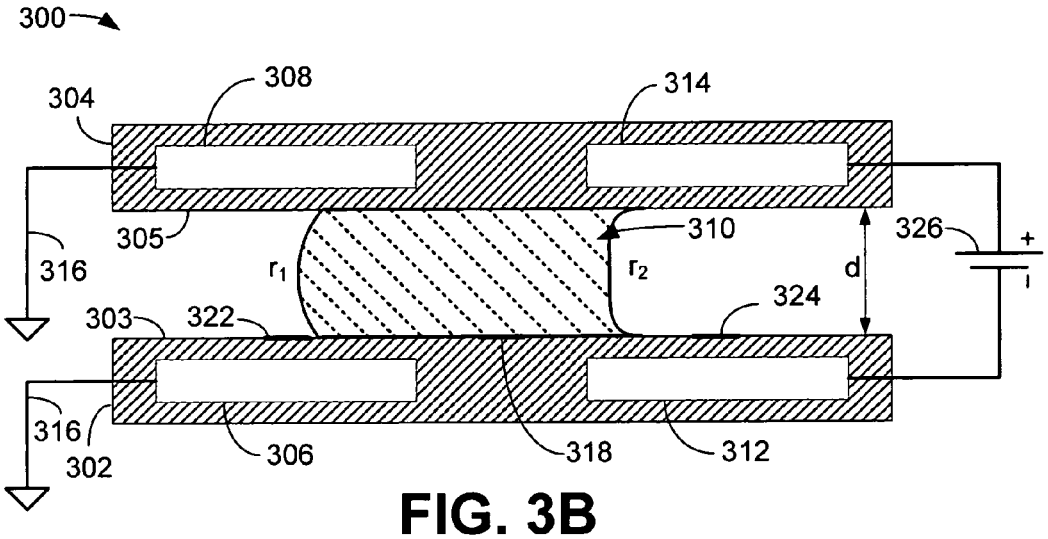
FIG. 3B is a schematic diagram illustrating the movement imparted to a droplet of conductive liquid as a result of the change in contact angle due to electrowetting.

FIG. 3B is a schematic diagram illustrating the movement imparted to a droplet of conductive liquid as a result of the pressure change of the droplet 310 caused by the reduction in contact angle due to electrowetting. When a voltage is applied to the electrodes 314 and 312 by the voltage source 326, the contact angle of the droplet 310 with respect to the surfaces 303 and 305 in FIG. 3A is reduced so that $r_1$ does not equal $r_2$. When the radii $r_1$ and $r_2$ differ, a pressure differential is induced across the droplet, thus causing the droplet to translate across the surfaces 303 and 305.

Figure 3C:
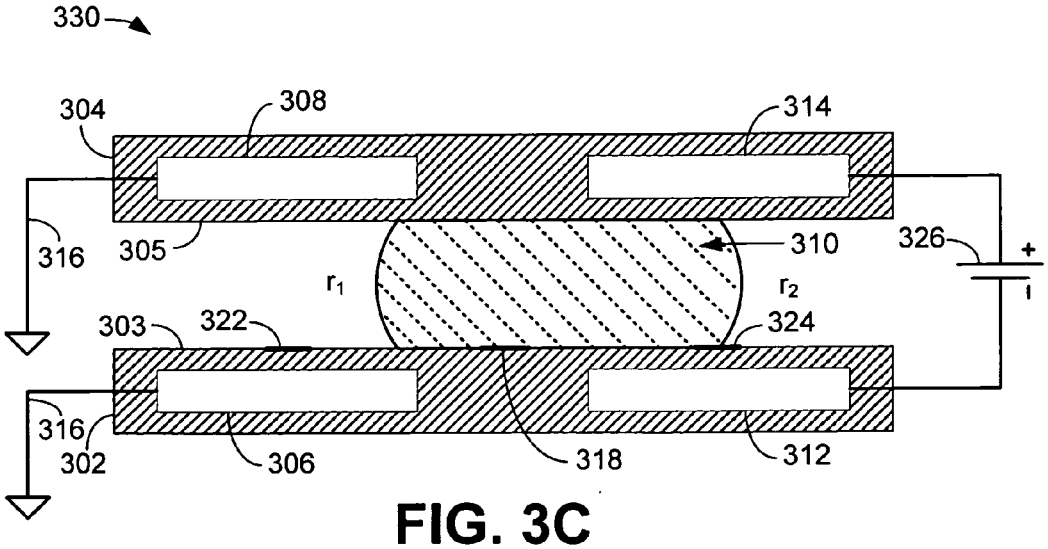
FIG. 3C is a schematic diagram illustrating the switch of FIG. 3A after the application of an electrical potential.

FIG. 3C is a schematic diagram 330 illustrating the switch 300 of FIG. 3A after the application of a voltage. As shown in FIG. 3C, the droplet 310 has moved and now electrically connects the input contact 318 and the output contact 324. In this manner, electrowetting can be used to induce translational movement in a conductive liquid and can be used to switch electronic signals.

Additional description of the fabrication of the switch 300 employing a conductive liquid droplet, including tailoring of the contact angle of the droplet, can be found in the above-identified U.S. patent application Ser. No. 10/996,823.

Figure 4A:
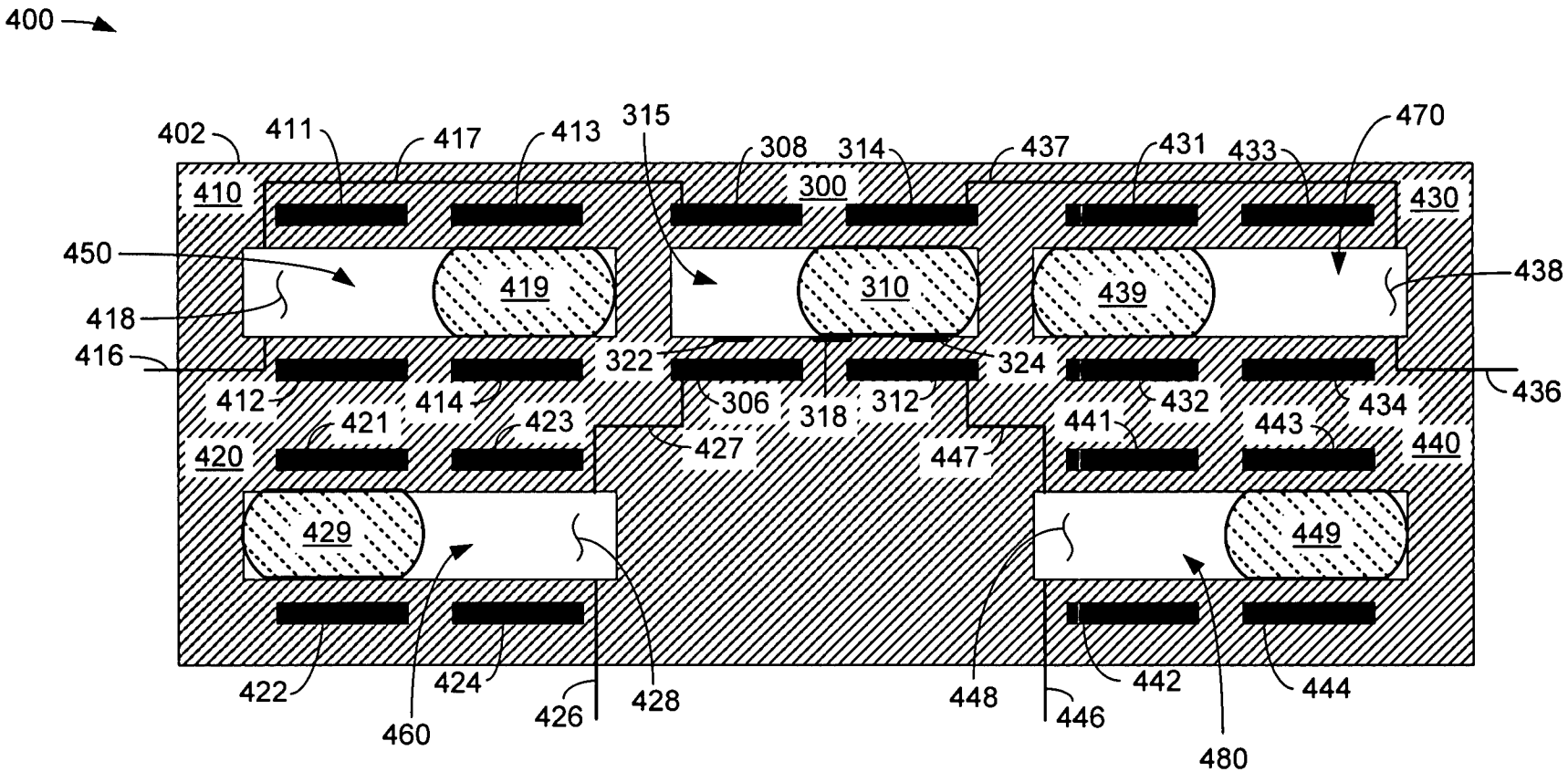
FIG. 4A is a schematic diagram illustrating a cross-section of a liquid metal switch assembly having an electrically isolated control element according to an embodiment of the invention.

FIG. 4A is a schematic diagram illustrating a cross-section of a liquid metal switch assembly having an electrically isolated control element according to an embodiment of the invention. The switch assembly 400 comprises a switch 300 and, in this embodiment, four isolation switches 410, 420, 430 and 440 located on a dielectric 402. In this example, the switch 300 is a single pole double throw (SPDT) switch and is sometimes referred to as an RF switch because it can be used to switch RF signals. The switches 410, 420, 430 and 440 are single pole single throw (SPST) switches and are referred to as "isolation" switches because they electrically isolate the control lines that supply the signal which causes the switch 300 to actuate from the electrical contacts 318, 322 and 324 associated with the switch 300. The dielectric 402 is similar to the dielectrics described above. However, in this embodiment, the dielectric 402 is illustrated as a single dielectric in which the switch 300 and the isolation switches 410, 420, 430 and 440 are located.

The switch 300 includes electrodes 306, 308, 312 and 314 as described above and a cavity 315, through which a droplet 310 of conductive liquid translates. The isolation switch 410 includes electrodes 411, 412, 413 and 414; the isolation switch 420 includes electrodes 421, 422, 423 and 424; the isolation switch 430 includes electrodes 431, 432, 433 and 434; and the isolation switch 440 includes electrodes 441, 442, 443 and 444. The control lines associated with the electrodes of isolation switches 410, 420, 430 and 440 are omitted for simplicity. The isolation switch 410 includes a cavity 450 through which a droplet 419 of conductive liquid translates. The isolation switch 420 includes a cavity 460 through which a droplet 429 of conductive liquid translates; the isolation switch 430 includes a cavity 470 through which a droplet 439 of conductive liquid translates; and the isolation switch 440 includes a cavity 480 through which a droplet 449 of conductive liquid translates. The isolation switches 410, 420, 430 and 440 operate in similar manner to the switch 300 described above. Alternatively, the isolation switches 410, 420, 430 and 440 may be actuated in a manner that does not use the electrowetting effect. For example, the isolation switches 410, 420, 430 and 440 may be actuated using heating elements that cause a confined gas to expand and cause the droplet of conductive liquid to move.

Electrode 308 is coupled to control line 417; electrode 306 is coupled to control line 427; electrode 314 is coupled to control line 437 and electrode 312 is coupled to control line 447. The control line 417 is terminated in the chamber 418 of the isolation switch 410 in a manner such that when the droplet 419 translates through the cavity 450 to occupy the chamber 418, the droplet 419 will be in electrical contact with the control line 417. A control line 416 is also terminated in the chamber 418 of the isolation switch 410 in a manner such that when the droplet 419 translates through the cavity 450 to occupy the chamber 418, the droplet will be in electrical contact with the control line 416. In this manner, when the droplet occupies the chamber 418, the droplet 419 completes an electrical connection between the control lines 416 and 417. Similarly, the control line 427 is terminated in the chamber 428 of the isolation switch 420 in a manner such that when the droplet 429 translates through the cavity 460 to occupy the chamber 428, the droplet 429 will be in electrical contact with the control line 427. A control line 426 is also terminated in the chamber 428 of the isolation switch 420 in a manner such that when the droplet 429 translates through the cavity 460 to occupy the chamber 428, the droplet 429 will be in electrical contact with the control line 426. In this manner, the droplet 429 completes an electrical connection between the control lines 426 and 427. The electrodes 312 and 314 are similarly coupled to isolation switches 430 and 440.

The control lines 416 and 426; and the control lines 436 and 446 can be coupled to a voltage source, such as the voltage source 326 described above. In this embodiment, the voltage source 326 can also be referred to as a control circuit, or control circuitry, that causes the droplet 310 to translate in the cavity 315 when the droplets 419 and 429; and the droplets 439 and 449 couple the voltage source 326 to the electrodes 306 and 308, or electrodes 312 and 314.

In accordance with an embodiment of the invention, when the droplets 419, 429, 439 and 449 are located as shown in FIG. 4A, the control signals that are coupled to control lines 416, 426, 436 and 446 are electrically isolated from the electrical contacts 318, 322 and 324 associated with switch 300. In this manner, capacitive coupling between the electrical contacts 318, 322 and 324 and the electrodes 306, 308, 312 and 314 is minimized, and substantially eliminated.

Figure 4B:
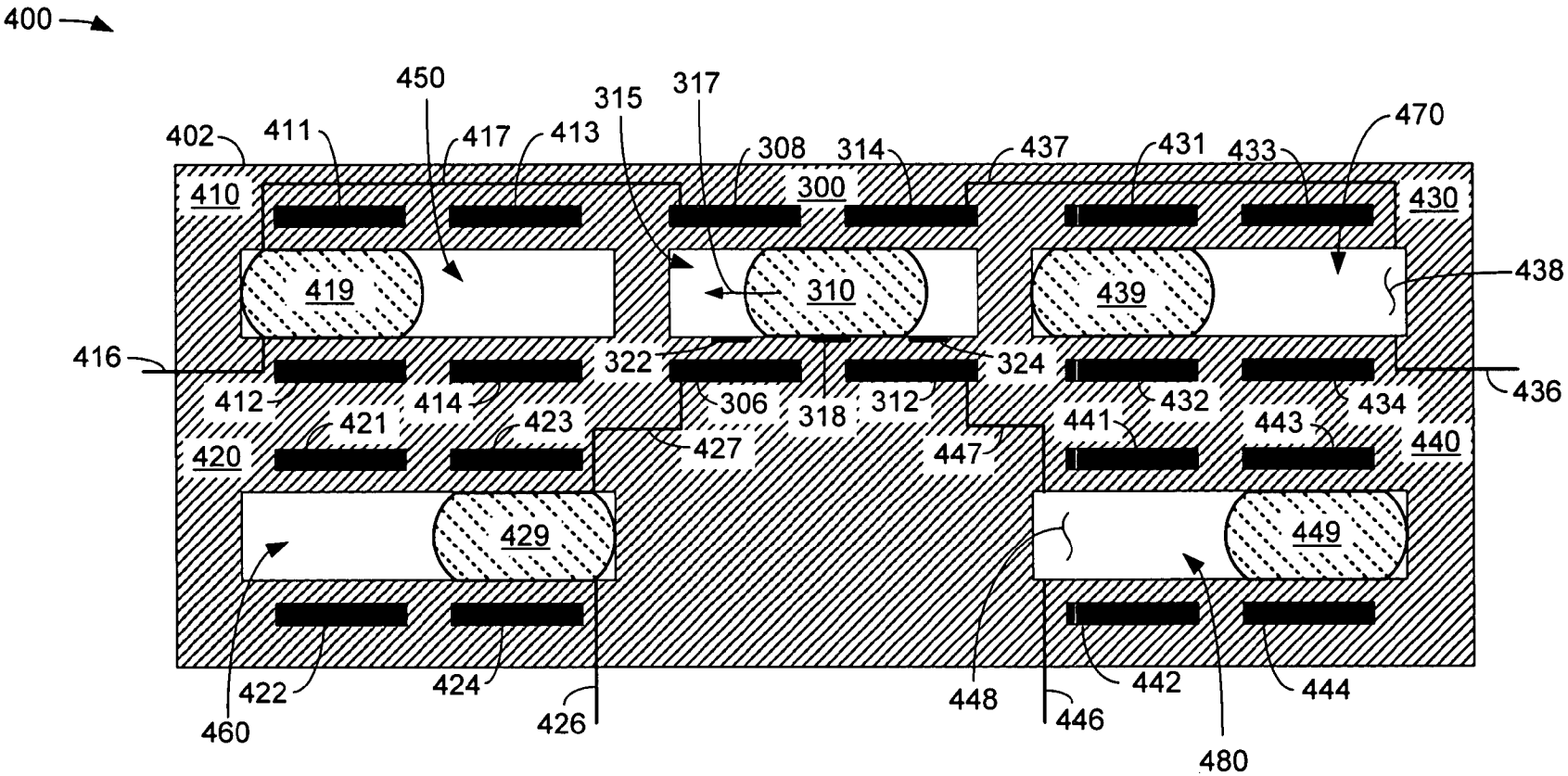
FIG. 4B is a schematic diagram illustrating a cross-section of the liquid metal switch assembly of FIG. 4A and showing the translation of the droplet of the switch.

FIG. 4B is a schematic diagram illustrating a cross-section of the liquid metal switch assembly 400 and showing the translation of the droplet 310 of the switch 300. The droplet 419 of the isolation switch 410 and the droplet 429 of the isolation switch 420 have translated through their respective cavities 450 and 460 and latched. By selecting the material of the droplet, the shape of the cavity in which the droplet translates and the material applied to surfaces of the cavity in which the droplet translates, it is possible to tailor the initial contact angle to ensure latching of the droplets, as more fully described in the above-identified U.S. patent application Ser. No. 10/996,823.

When the droplet 419 translates through the cavity 450, the droplet 419 completes an electrical connection between the control line 416 and the control fine 417. In this manner, an electrical control signal is delivered to the electrode 308 of the RF switch 300. The electrical control signals and control lines that cause the droplet 419 to translate through the cavity 450 are omitted for simplicity. The droplet 419 is caused to move as described above with respect to FIGS. 2A, and 2B; and FIGS. 3A, 3B and 3C. After the droplet 419 latches, the control signal that caused the droplet to translate may be removed. By latches is meant that once the droplet translates through the cavity 450 it remains there until it is caused to translate in the opposite direction.

Similarly, when the droplet 429 translates through the cavity 460, the droplet 429 completes an electrical connection between the control line 426 and the control line 427. In this manner, an electrical control signal is delivered to the electrode 312 of the switch 300. The electrical control signals and control lines that cause the droplet 429 to translate through the cavity 460 are omitted for simplicity. The droplet 429 is caused to move as described above with respect to FIGS. 2A, and 2B; and FIGS. 3A, 3B and 3C. When the control signal is delivered to the electrodes 308 and 312 of the switch 300, the droplet 310 is caused to translate through the cavity 315 as illustrated by the arrow 317. When the droplet 310 translates through the cavity 315, an RF signal supplied to electrical contact 318 can be switched from output electrical contact 324 to output electrical contact 322. In this example, only the isolation switches 410 and 420 are actuated. If it is desired to translate the droplet 310 in the opposite direction, then isolation switches 430 and 440 are actuated in a similar manner to that described with respect to isolation switches 410 and 420.

Figure 4C:
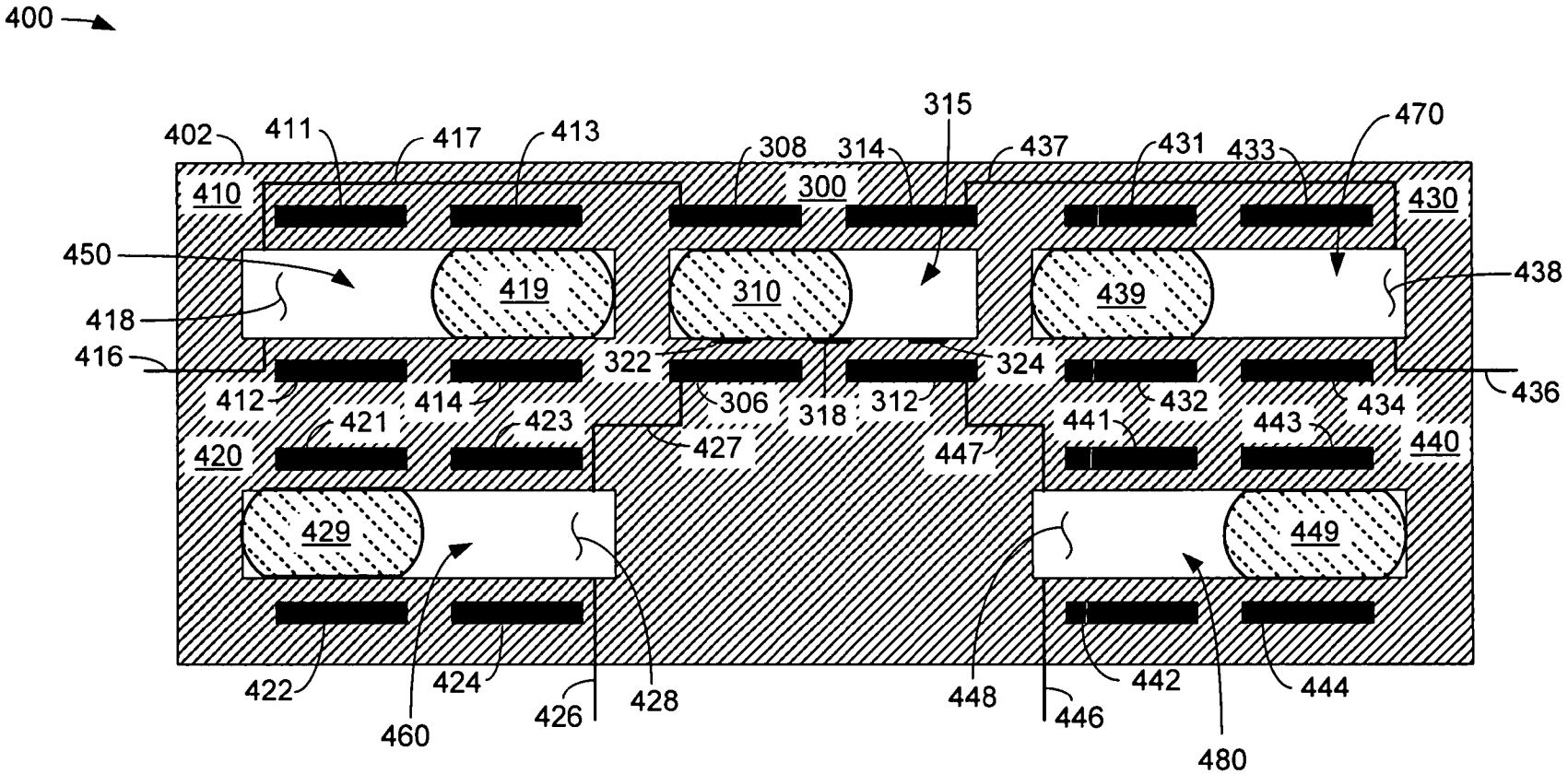
FIG. 4C is a schematic diagram illustrating a cross-section of the liquid metal switch assembly of FIG. 4B and showing the completed translation of the droplet of the switch.

FIG. 4C is a schematic diagram illustrating a cross-section of the liquid metal switch assembly 400 and showing the completed translation of the droplet 310 of the switch 300. After the droplet 310 has translated through the cavity 315 and has switched the RF signal from output electrical contact 324 to output electrical contact 322, the isolation switches 410 and 420 are again actuated. The isolation switch 410 is actuated to translate the droplet 419 back to its position as shown in FIG. 4A. In this manner, the electrical circuit coupling the electrode 308 to the control line 416 is broken, thus presenting a high impedance and electrically isolating the control line 417 and preventing electrical coupling of the RF signal from the electrical contacts 318 or 322 into the control line 416. Similarly, the isolation switch 420 is actuated to translate the droplet 429 back to its position as shown in FIG. 4A. In this manner, the electrical circuit coupling the electrode 306 to the control line 426 is broken, thus presenting a high impedance and electrically isolating the control line 427 and preventing electrical coupling of the RF signal from the electrical contacts 318 or 322 into the control line 426.

The isolation switches 430 and 440 can be actuated as described above with respect to isolation switches 410 and 420 to cause the RF switch 300 to again actuate and translate the droplet 310 in the opposite direction.

Figure 5:
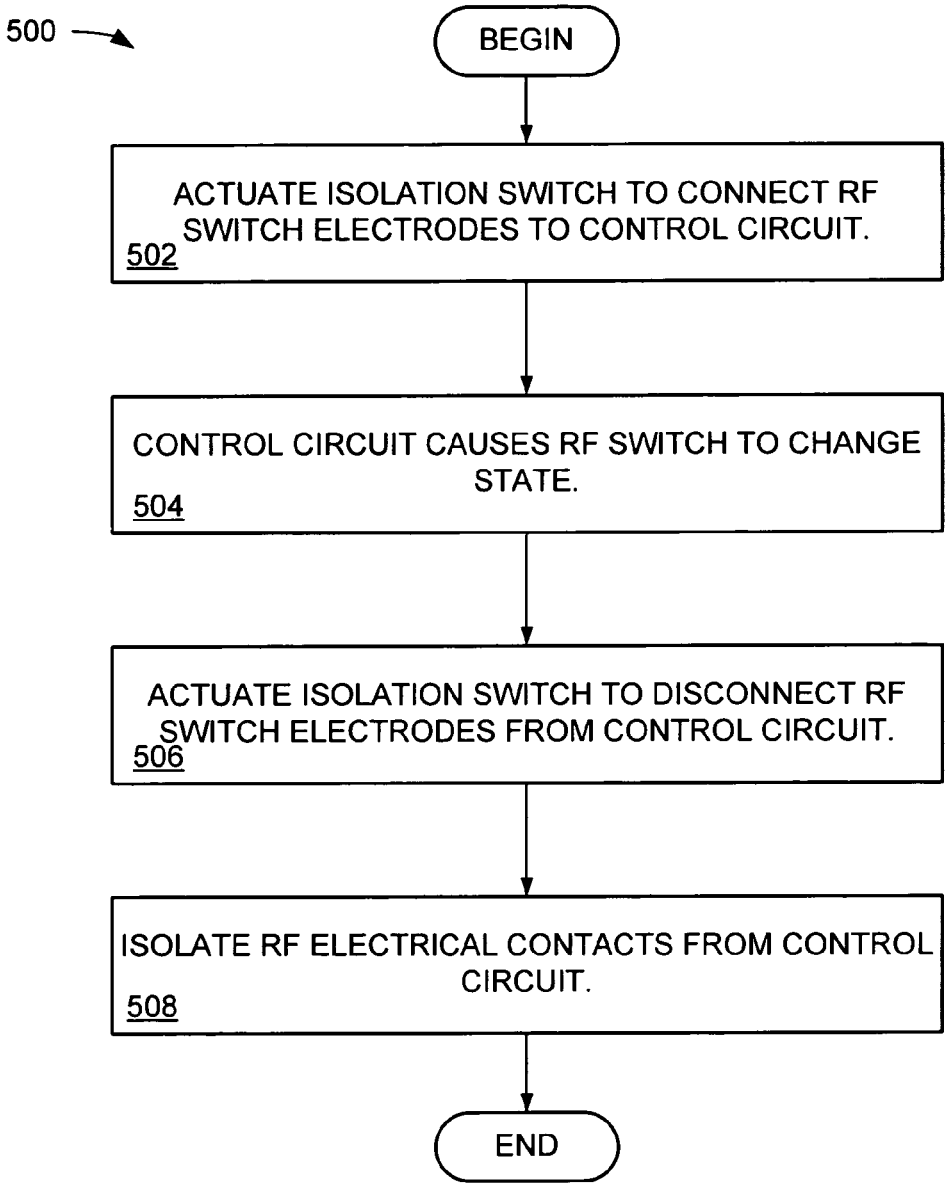
FIG. 5 is a flowchart illustrating an embodiment of the operation of the liquid metal switch of FIGS. 4A, 4B and 4C.

FIG. 5 is a flowchart 500 illustrating an embodiment of the operation of the liquid metal switch of FIGS. 4A, 4B and 4C. In block 502, the isolation switches 410 and 420 are actuated to connect the electrodes 306 and 308 of the switch 300 to control lines 426 and 416, respectively. In block 504, the control circuit causes the switch 300 to change state by translating through the cavity 315. In block 506, the isolation switches 410 and 420 are actuated to electrically disconnect the electrodes 306 and 308 of the switch 300 from the control lines 426 and 416, respectively. In block 508, the electrical contacts 318, 322 and 324 of the switch 300 are electrically isolated from the control lines 416 and 426 because the electrodes 306 and 308 no longer have an electrical connection path to the control lines 426 and 416, respectively.

This disclosure describes the invention in detail using illustrative embodiments. However, it is to be understood that the invention defined by the appended claims is not limited to the precise embodiments described.

I claim:

1. A switch, comprising:

a first switch element configured to actuate by electrowetting, the first switch element comprising at least two radio frequency contacts and at least two control electrodes; and at least two additional switch elements configured to make and break an electrical connection between the at least two control electrodes of the first switch element.

2. The switch of claim 1, in which the electrical connection comprises control lines configured to actuate the first switch element.

3. The switch of claim 2, in which the at least two additional switch elements actuate by electrowetting and isolate the at least two radio frequency contacts from the control lines.

4. The switch of claim 1, wherein the at least two additional switch elements translate in respective cavities to isolate the at least two radio frequency contacts from the control lines.

5. The switch of claim 4, in which the first switching element is a single pole double throw switch.

6. The switch of claim 4, in which the at least two additional switching elements are single pole single throw switches.

7. The switch of claim 4, in which the first switch element and the at least two additional switch elements are two position switches that latch.

8. A method for operating a switch, comprising:

supplying an actuating signal to at least two switch elements to electrically connect electrodes of an additional switch element to respective control lines;

supplying an actuating signal to the additional switch element using an electrowetting effect to cause the additional switch element to change state;

supplying an actuating signal to the at least two switch elements to disconnect the electrodes of the additional switch element from the respective control lines; and isolating electrically radio frequency (RF) electrical contacts of the additional switch element from the respective control lines.

9. The method of claim 8, further comprising using an electrowetting effect to translate a droplet of conductive liquid through a respective cavity to contact the control lines.

10. The method of claim 9, further comprising translating a droplet of conductive liquid through a respective cavity to electrically decouple the control lines from the RF electrical contacts of the additional switch.

11. The method of claim 10, wherein the at least two switch elements and the additional switch element latch.

12. The method of claim 11, further comprising removing the actuating signal from the at least two switch elements and the additional switch element after the switch elements latch.

13. The method of claim 11, further comprising switching an RF signal through the additional switch element.

14. A switch, comprising:

a first switch element configured to actuate by electrowetting, the first switch element comprising at least two radio frequency contacts and at least two electrodes; and at least two additional switch elements configured to make and break an electrical connection between the at least two electrodes of the first switching element and respective control lines associated with the at least two electrodes.

15. The switch of claim 14, in which the at least two additional switch elements are configured to actuate by electrowetting and isolate the at least two radio frequency contacts from the control lines.

16. The switch of claim 15, in which the at least two additional switch elements translate in respective cavities to isolate the at least two radio frequency contacts from the control lines.

17. The switch of claim 16, in which the first switching element is a single pole double throw switch.

18. The switch of claim 16, in which the at least two additional switching elements are single pole single throw switches.

19. The switch of claim 16, in which the first switch element and the at least two additional switch elements are two position switches that latch.

* * * * *